United States Patent [19]

O'Connor

[11] 3,988,862

[45] Nov. 2, 1976

[54] STRUCTURE FOR TOTAL FORM ABRASION MACHINING

[76] Inventor: Thomas J. O'Connor, 100 Morgan Road, Ann Arbor, Mich. 48106

[22] Filed: Mar. 11, 1976

[21] Appl. No.: 666,001

Related U.S. Application Data

[60] Division of Ser. No. 633,614, Nov. 20, 1975, which is a continuation of application Ser. No. 397,336, Sept. 14, 1973, abandoned, which is a continuation-in-part of Ser. Nos. 68,711, Sept. 1, 1970, and Ser. No. 253,906, May 16, 1972, which is a division of Ser. No. 545,652, April 27, 1966, Pat. No. 3,663,786.

[52] U.S. Cl. ..... 51/157; 51/59 R; 219/69 V

[51] Int. Cl.[2] ..... B24B 19/00

[58] Field of Search ..... 51/6, 58, 59, 119, 157, 51/281 R; 219/69 V

[56] References Cited

UNITED STATES PATENTS

| | | | |
|---|---|---|---|
| 655,472 | 8/1900 | Wishart | 51/6 |
| 2,452,211 | 10/1948 | Rosenthal | 51/59 |
| 2,580,716 | 1/1952 | Balamuth | 51/59 |
| 2,766,364 | 10/1965 | Higgins | 219/69 |
| 3,114,029 | 12/1963 | Pascoe | 219/69 |
| 3,135,852 | 6/1964 | Bentley | 219/69 |
| 3,433,919 | 3/1969 | Braudeau | 219/69 |
| 3,564,190 | 2/1971 | Kandajan | 219/69 |
| R27,588 | 2/1973 | Hausermann | 51/157 |

FOREIGN PATENTS OR APPLICATIONS

| | | | |
|---|---|---|---|
| 1,379,623 | 10/1964 | France | 51/157 |
| 1,451,464 | 7/1966 | France | 51/157 |

*Primary Examiner*—Harold D. Whitehead
*Attorney, Agent, or Firm*—Whittemore, Hulbert & Belknap

[57] ABSTRACT

A machine for producing a rotary orbital motion between a cutting master having an abrasive mirror image surface of a form to be abraded into a friable material and a workpiece of friable material while moving the surface of the cutting master and workpiece into contact including adjustable eccentric means for varying the rotary orbital motion between the workpiece and the cutting master, a hydraulic piston and cylinder for moving the cutting master and workpiece into engagement with each other during imparting of the rotary orbital motion between the cutting master and workpiece, hydraulic means for applying predetermined variable pressure between the cutting master and workpiece, a control circuit for controlling the operation of the total form abrading machine including means for controlled pulsing of the cutting master away from the workpiece, and means for flushing between the electrode and workpiece during an abrading operation, and the method of using the total form abrading machine.

6 Claims, 13 Drawing Figures

FIG. 10
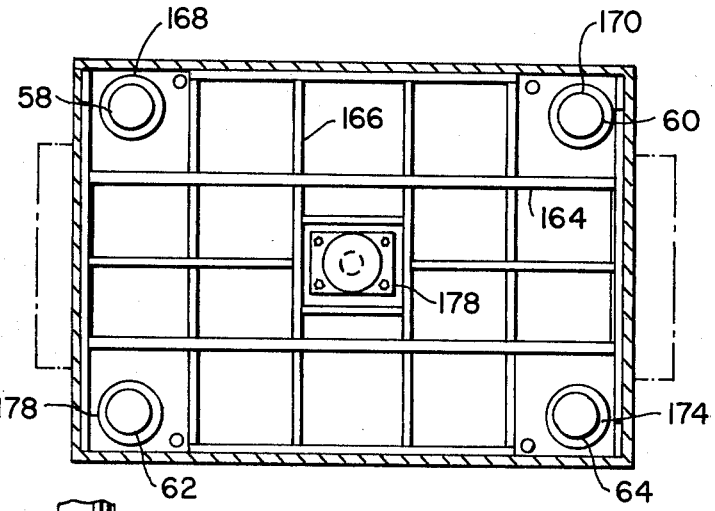
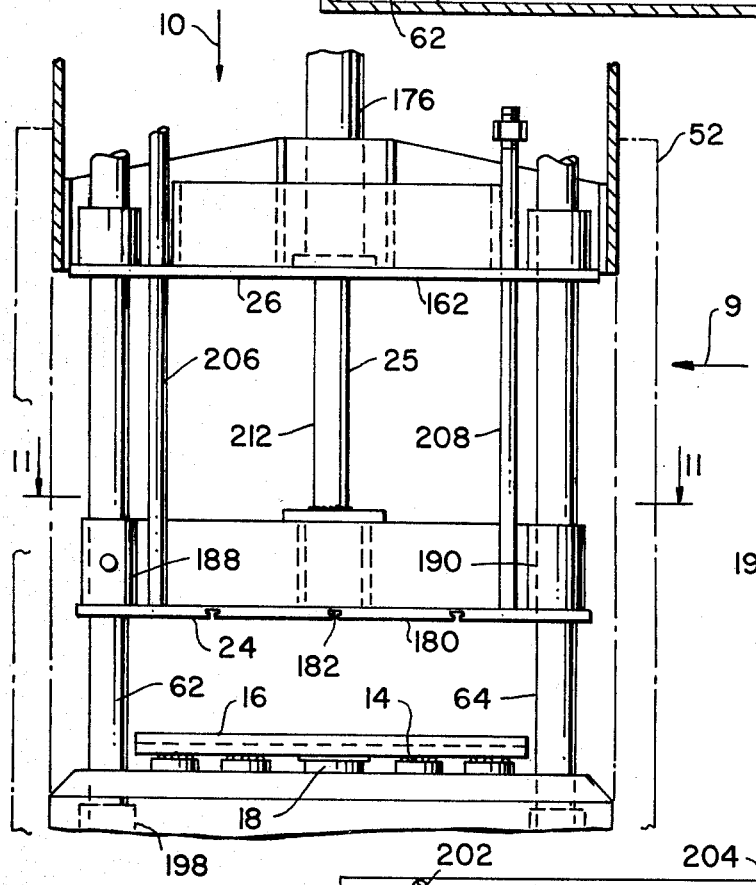
FIG. 8
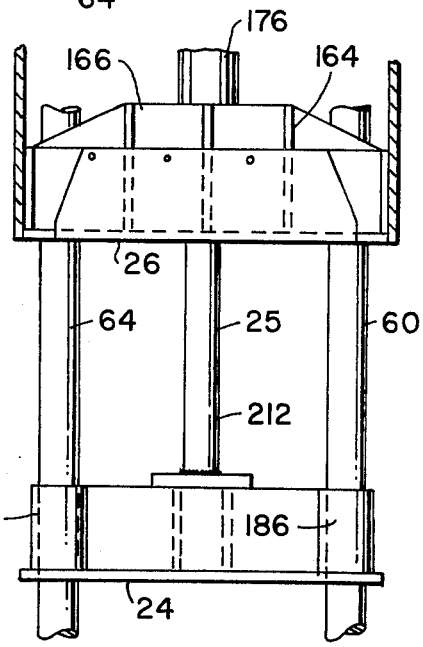
FIG. 9
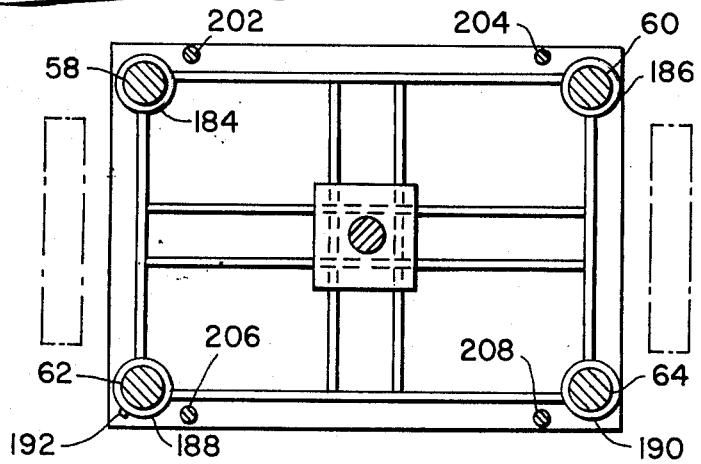
FIG. 11

STRUCTURE FOR TOTAL FORM ABRASION MACHINING

This application is a division, of application Ser. No. 633,614, filed Nov. 20, 1975, and now abandoned, which is a continuation-in-part of application Ser. No. 68,711, filed Sept. 1, 1970, and application Ser. No. 253,906, filed May 16, 1972, which applications were divisional applications of parent application Ser. No. 545,652, filed Apr. 27, 1966, now U.S. Pat. No. 3,663,786.

BACKGROUND OF THE INVENTION

1. Field of the Invention

The invention relates to total form abrasion machining of friable material and refers more specifically to structure for and the method of providing precision total form abraded workpieces including structure for producing relative rotary orbital motion between a work table having a friable workpiece secured thereon and a cutting master which includes an abrasive mirror image surface of a form to be abraded into the friable workpiece while relatively moving the workpiece and mirror image surface of the cutting master toward and away from each other, controlling the pressure exerted between the workpiece and cutting master, and flushing between the workpiece and cutting master.

2. Description of the Prior Art

The best known prior art is provided in the above referenced patent and patent applications and the references cited therein. Prior to these references, it is believed that total form abrasion machining was unknown as a precision machining process. Accordingly, no total form abrasion machining structures of the type disclosed herein were available. It appears that where articles were formed by abrasion in the past, they were sculptured as with a chisel, etched as with an etching needle, or perhaps ground with a grinding wheel, each of which processes produced either point or line machining rather than total form machining.

In addition, electro erosion machining has been known in the past but it is an electrical process rather than a mechanical process such as the total form abrasion machining method and structure considered herein. It has also been known in the past to combine electrical discharge machining with or without cavitation in which high frequency oscillations are provided in conjunction with a fluid having abrasive particles therein. Again, such machining is different from the total form abrasion machining disclosed herein in that no cutting masters having abrasive surfaces and different size mirror image surfaces are used in such machining, and there is further no suggestion of a rotary orbital or any type of orbital movement being employed in such machining as there is with the total form abrasion machining structure and method disclosed herein.

SUMMARY OF THE INVENTION

The total form abrasion machining structure disclosed includes a table for receiving a workpiece of a friable material such as graphite or the like and structure for imparting a rotary orbital movement to the table including a gear train drive, eccentric means, and bearings for supporting the table during the rotary orbital movement thereof. The structure for total form abrasion machining further includes means for supporting a cutting master having an abrasive surface which is the mirror image of a form to be machined in the workpiece above the workpiece and means for moving the mirror image surface of the cutting master toward and away from the workpiece. A hydraulic circuit is also provided for controlling the pressure with which the cutting master is engaged with the workpiece along with means for pulsing the cutting master away from the workpiece periodically and means for flushing fluid between the workpiece and cutting master during machining.

The total form abrasion machining method disclosed includes producing a rotary orbital motion between a friable workpiece such as a graphite or carbon block and a cutting master, which cutting master has an abrasive mirror image surface of a form to be machined thereon, relatively moving the workpiece and cutting master into contact under a controlled pressure and variously pulsing the cutting master out of contact with the workpiece or at least relieving the pressure between the cutting master and workpiece while flushing between the cutting master and workpiece.

BRIEF DESCRIPTION OF THE DRAWINGS

FIG. 8 is a diagrammatic front view of the ram, platens and posts of the total form abrasion machine illustrated in FIG. 1.

FIG. 9 is an elevation view of the ram, platens and posts illustrated in FIG. 8, taken in the direction of arrow 9 in FIG. 8.

FIG. 10 is a top view of the ram, platens and posts illustrated in FIG. 8, taken in the direction of arrow 10 in FIG. 8.

FIG. 11 is a partial section view of the ram, platens and posts illustrated in FIG. 8, taken substantially on the line 11—11 in FIG. 8.

DESCRIPTION OF THE PREFERRED EMBODIMENT

Figure 1:
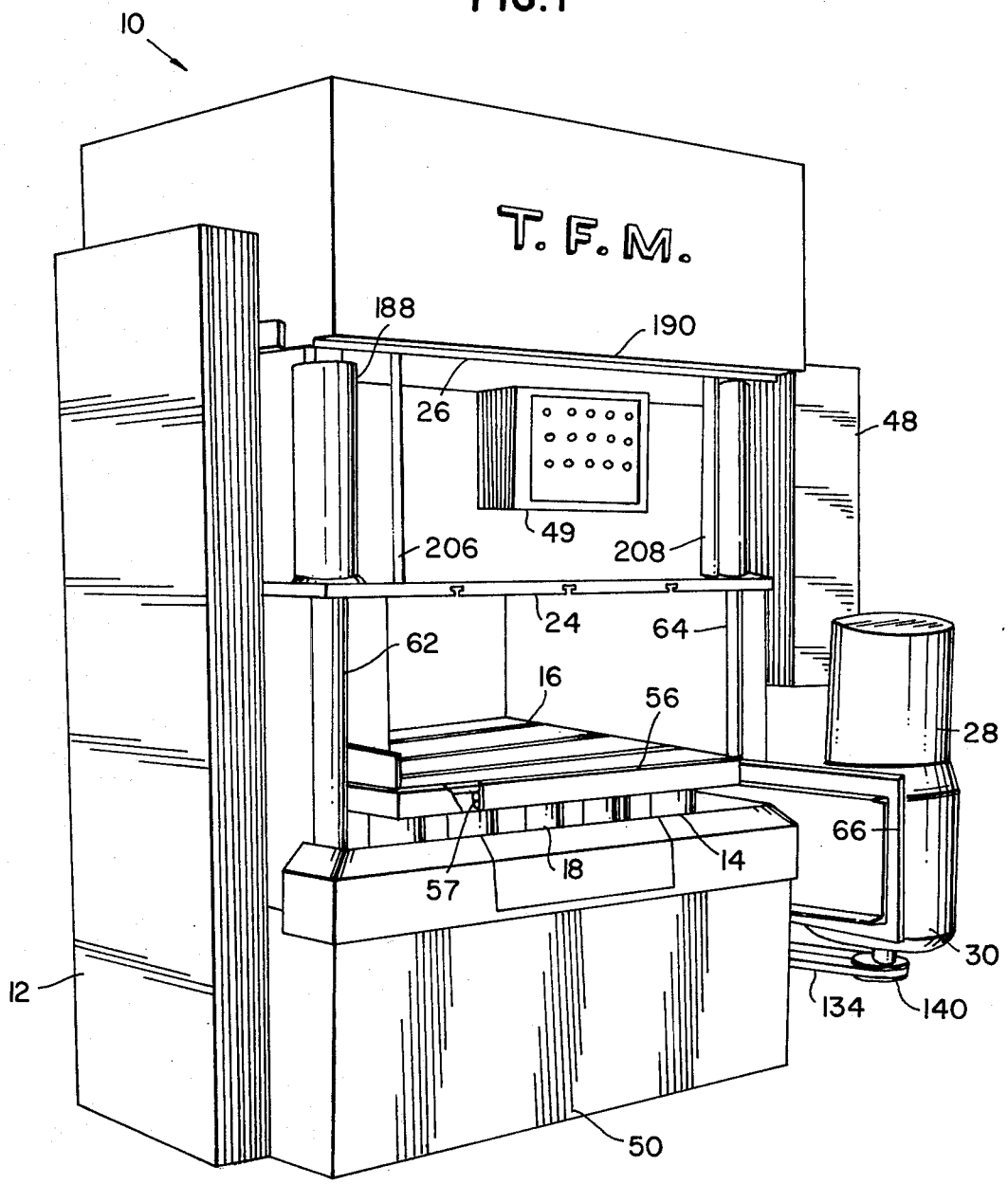
FIG. 1 is a perspective view of a total form abrasion machining machine constructed in accordance with the invention for performing the total form abrasion machining method of the invention.

The total form abrading machine 10 illustrated in FIG. 1 includes a structural frame 12, bearing structures 14 for supporting a work table 16 on the structural frame, a pair of coordinated eccentric means 18 and 20 for imparting a rotary, orbital motion to the table 16, and drive means 22 for driving the eccentric means 18 and 20 and thus the table 16 in its rotary, orbital movement.

The total form abrading machine 10 further includes a lower platen 24 for supporting a cutting master over a workpiece on the table 16, an upper platen 26 secured to the frame 12, and ram means 25 positioned between the platens 24 and 26 for moving the lower platen toward and away from the work table 16.

The total form abrasion machine 10 is completed with the drive motor 28 and clutch 30 along with the flushing system 40. The flushing system 40 includes the storage tank 42, pump 44 and filter 46.

Figure 13:
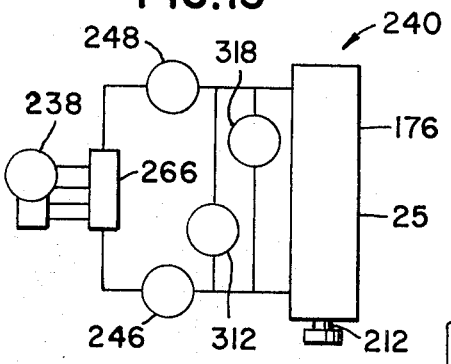
FIG. 13 is a diagrammatic view of a portion of the hydraulic control circuit of the total form abrasion machine illustrated in FIG. 1.
Figure 12:
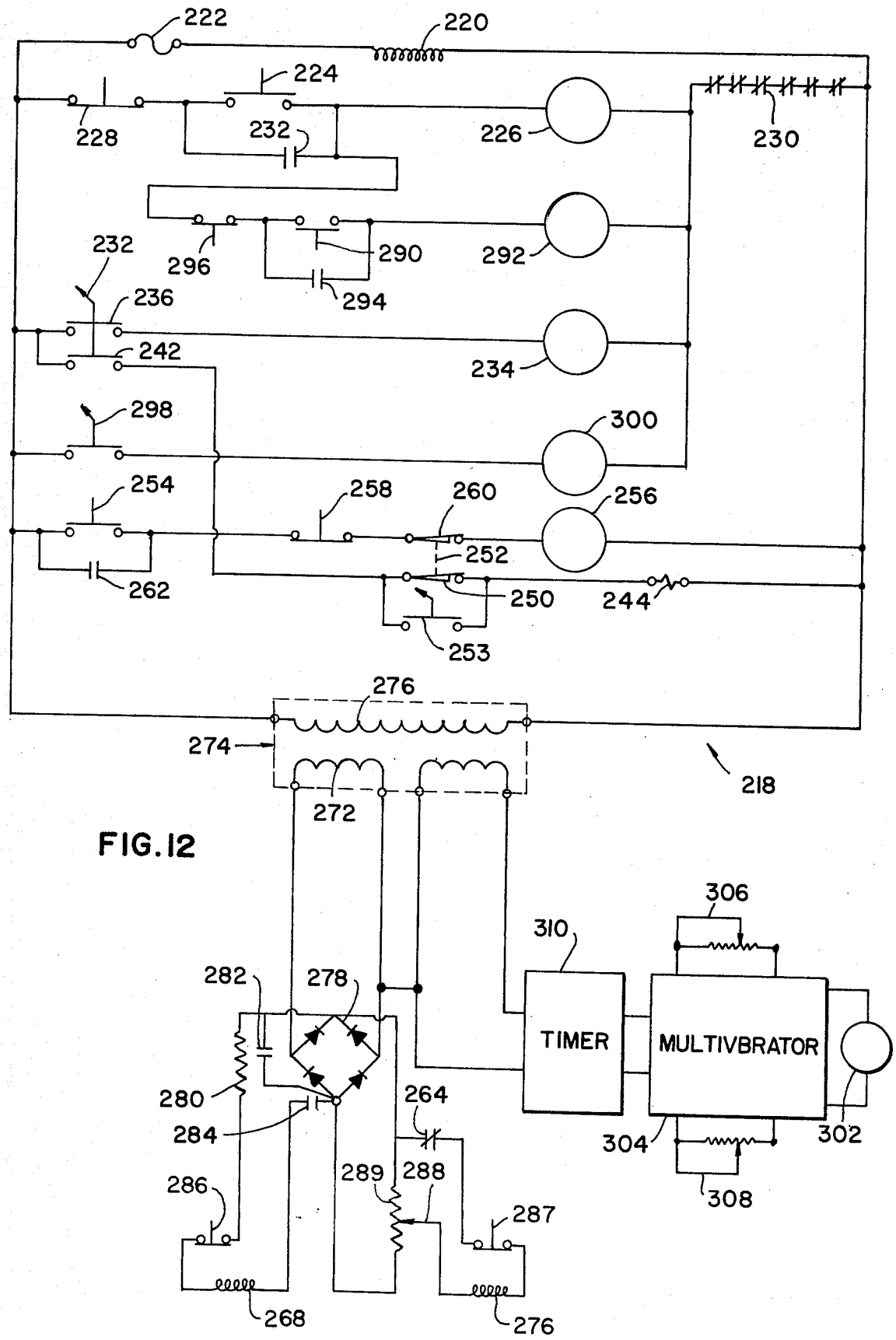
FIG. 12 is a schematic diagram of the electrical control circuit of the total form abrasion machine illustrated in FIG. 1.

The electrical circuit of FIG. 12 is included in the cabinet 48 and control box 49 secured to the frame 12. The hydraulic circuit of FIG. 13 is provided in conjunction with the ram structure 24 and is also supported by the frame 12 in the upper portion of the machine 10 above the upper platen 26.

Figure 4:
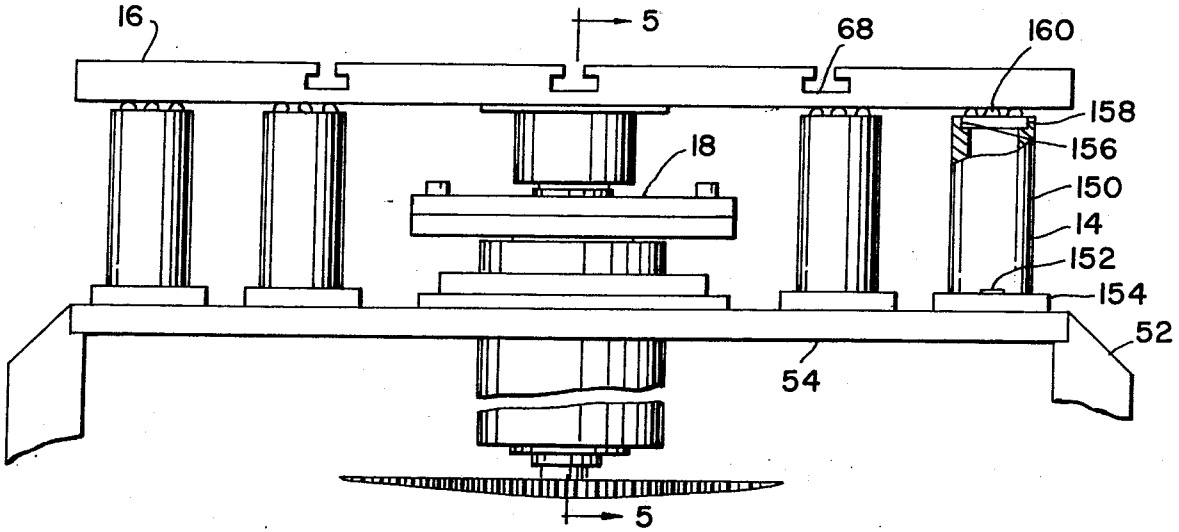
FIG. 4 is an enlarged diagrammatic elevation view of a portion of the structure for imparting a rotary, orbital motion to the table of the total form abrasion machine illustrated in FIG. 1.

More specifically, the frame 12 is constructed of metal plates 50 welded to structural members such as members 52 to provide a relatively heavy, rigid support for the structural plate 54, as shown for example in FIG. 4, and for rigidly supporting the upper platen 26 as shown best in FIG. 8. Structural members 66 secured to the frame 12 provide support for the motor 28, clutch 30, and motor 46 of the total form abrading machine 12 and may be provided as required.

Figure 5:
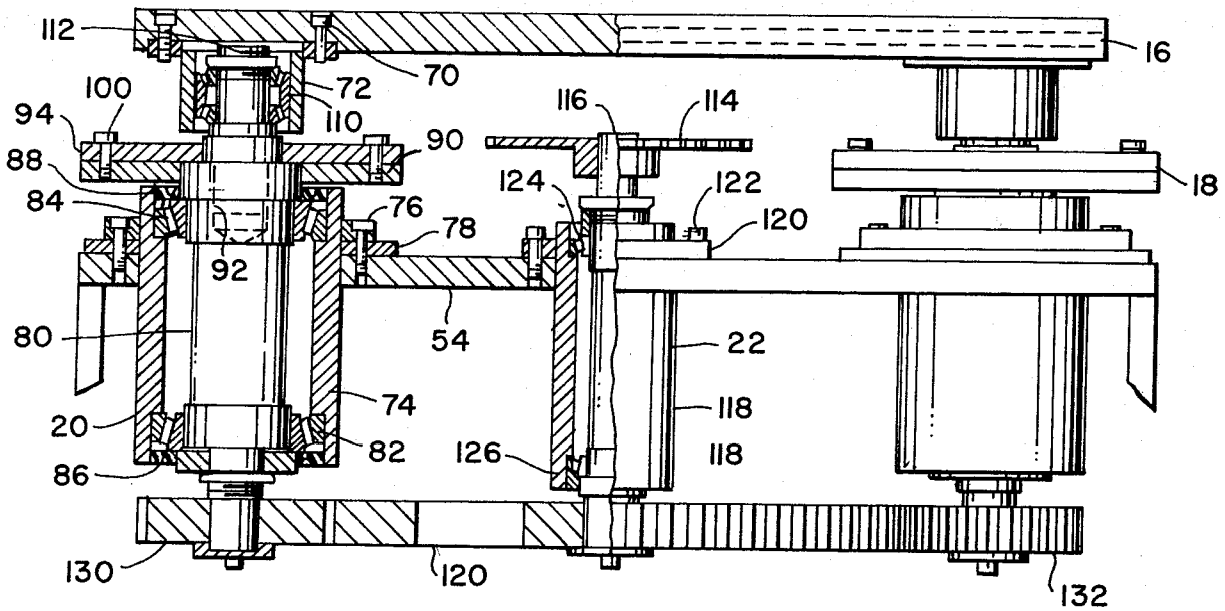
FIG. 5 is a partial section view of the structure for imparting a rotary, orbital motion to the table of the total form abrasion machine illustrated in FIG. 1 taken substantially on the line 5—5 of FIG. 4.

The table 16 as shown best in FIGS. 4 and 5 is a flat table having inverted T-shaped slots 68 extending across the length thereof. The slots 68 permit securing a block such as a block of graphite from which an electrode for electrical discharge machining for example may be machined to the table 16. As shown, the table 16 is connected to the eccentric means 18 and 20 by convenient means such as the bolts 70 and collar 72. The table 16 is further supported for rotary, orbital movement on the bearing structures 14, as shown best in FIG. 4. In addition, a peripheral flange 56 is provided around the table 16 which defines a drain channel 57 for flush fluid.

The eccentric means 18 and 20 for imparting rotary, orbital movement to the table 16 are identical. The eccentric means 18, as shown best in FIG. 5, includes an outer sleeve 74 which is secured to the fixed structural plate 54 by means of the bolts 76 and the collar 78. A spindle 80 is rotatably supported within the sleeve 74 on the bearings 82 and 84 at the opposite ends thereof. Grease seals 86 and 88 are provided at the opposite ends of the sleeve 74 between the sleeve 74 and the spindle 80.

A disc 90 is secured to the spindle 80, as shown best in FIG. 5, at the upper end thereof and a recess 92 which is eccentric with the axis of rotation of the spindle 80 is provided in the spindle 80.

Figure 6:
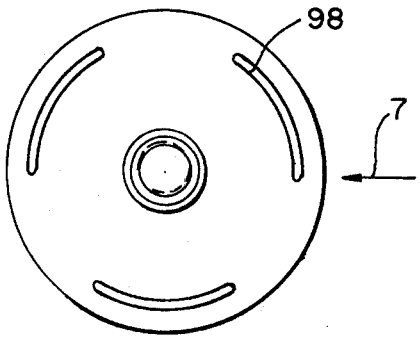
FIG. 6 is a top view of the eccentric member of the structure illustrated in FIG. 5.
Figure 7:
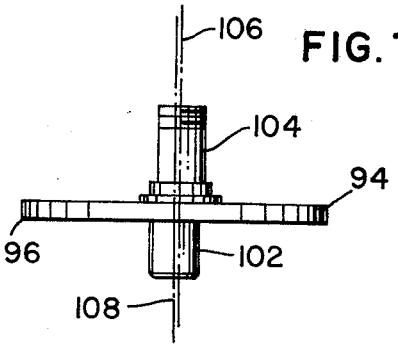
FIG. 7 is an elevation view of the eccentric member illustrated in FIG. 6, taken in the direction of arrow 7 in FIG. 6.

An eccentricity adjusting member 94, best shown in FIGS. 6 and 7, is positioned on the spindle 80. The eccentricity adjusting member includes a central disc 96 having the arcuate slots 98 therein through which bolts 100 extend to lock the disc 96 in an angularly adjusted position with respect to the disc 90 on the spindle 80. Further, the eccentricity adjusting member 94 is provided with a cylindrical portion 102 which in assembly is eccentric with the axis of rotation of the spindle 80. The cylindrical portion 104 of the eccentricity adjusting member 94 is, however, offset with regard to the cylindrical portion 102, as indicated by the two separate center lines 106 and 108 in FIG. 7. The cylindrical portion 104 is concentric with the axis of rotation of the spindle 80 with the cylindrical portion 102 within the recess 92 in spindle 80 and the disc 94 in one angular position on the disc 90. The eccentricity between the spindle 80 and the cylindrical portion 104 may thus be adjusted by angular movement of the disc 94 on the disc 90.

The cylindrical portion 104 is connected to the table 16 by the bolts 70 through the bearings 110 having an outer race connected to the collar 72 and an inner race positioned on the cylindrical portion 104 and secured thereto by the nut 112.

The drive train 22 for the eccentric members 18 and 20 includes a sprocket 114 secured to a shaft 116. The shaft 116 is rotatably mounted in sleeve 118 which is supported in a fixed position on the structural plate 54 by the collar 120 and bolts 122. The shaft 116 is rotatably supported in the shaft 118 by the upper and lower bearings 124 and 126, respectively.

A drive gear 128 is secured to the lower end of the shaft 116 as shown in FIG. 5 for rotation therewith on rotation of the sprocket 114. The drive gear 128 is engaged with the pinions 130 and 132 which in turn are secured to the lower ends of the spindles 80 in the eccentric structures 18 and 20, as shown in FIG. 5.

The sprocket 114 is driven by motor 28 through clutch 30 and chain drives 134 and 136 from the sprocket 140 and through gear box 142. Thus, when the motor 28 is turned on and the clutch 30 is energized or engaged, the sprocket 140 will rotate to drive the chain 134 which drives the chain 136 through the gear box 142 to rotate the sprocket 114 and shaft 116. Rotation of the shaft 116 will cause rotation of the gear 128 to drive the pinions 130 and thus rotate the spindles 80 in the eccentric structures 18 and 20 to produce a rotary, orbital motion of the table 16 in accordance with the relative angular positions of the discs 90 and 94.

The bearing structures 14 are cylindrical sleeves 150 secured to the structural plate 54 by bolts 152 extending through collars 154 secured to the cylindrical sleeves as by welding, for example. The cylindrical sleeves 154 have an annular recess 156 in the upper ends thereof in which an annular ball bearings race 158 is positioned for supporting the ball bearings 160 which engage table 16 and support the load on the table 116. Thus, the eccentrics 18 and 20 are substantially unloaded.

The upper platen 26, as shown best in FIGS. 8 and 10, includes a lower structural plate 162 and structural cross braces 164 and 166 extending the length and width thereof which are secured to plates 50 and structural members 52 as by welding. Upper bearings 168, 170, 172 and 174 are secured to the structural plate 156 of the upper platen 26 by convenient means such as welding. The hydraulic cylinder 176 of the ram structure 24 is also secured to the structural plate 156 centrally thereof, as in FIG. 10, by convenient means such as bolts 178.

The lower platen 24, as shown best in FIGS. 8 and 11 includes a bottom plate 180 having the T-shaped slots 182 extending across the width thereof for use in securing a master cutter thereto. The lower platen 24 is further provided with the bushings 184, 186, 188 and 190 through which the posts 58, 60, 62 and 64, respectively, extend.

Further, the posts are secured to the bushings 184, 186, 188 and 190 by convenient means such as bolts 192 so that the posts 58, 60, 62 and 64 move up and down in the upper bushings 168, 170, 172 and 174 and in the lower bushings 194, 196, 198 and 200 which are secured on the structural plate 54 as the lower platen 24 is moved up and down. The posts 58, 60, 62 and 64 are thus guided at both ends during up and down movement thereof so that exact tolerances may be maintained.

Hanger rods 202, 204, 206 and 208 are secured to the bottom plate 180 of the lower platen 24 and extend through the openings in the bottom plate 62 of the upper platen 26. The rods 26 are provided with nuts 210 on the upper ends thereof which limit the ultimate downward movement of the lower platen 24 and the posts 58, 60, 62 and 64 carried thereon.

In operation, to move a cutting master toward or away from a workpiece positioned on the table 16, the cutting master is secured to the upper platen 24 by convenient means such as clamps secured in the slots 182 and the hydraulic system as illustrated diagrammatically in FIG. 13 is actuated to move the rod 212 of the ram structure 24 into or out of the cylinder 176 having a piston therein to which the rod 212 is secured. On movement of the rod 212, the lower platen 24 is moved up or down along with the posts 58, 60, 62 and 64 to which they are secured by the screw means 192.

The posts 58, 60, 62 and 64 are guided in their vertical movement in the bushings 184, 186, 188 and 190 at the top thereof and in the bushings 202, 204, 206 and 208 secured to the structural plate 54. The upper limit of the movement of the lower platen 24 is provided by the positioning of the upper platen 26 and the stroke of the rod 212 within the piston 176 which is secured to the upper platen 26. The lower limit of the movement of the lower platen 24 is provided by the hanger rods 202, 204, 206 and 208.

Figure 2:
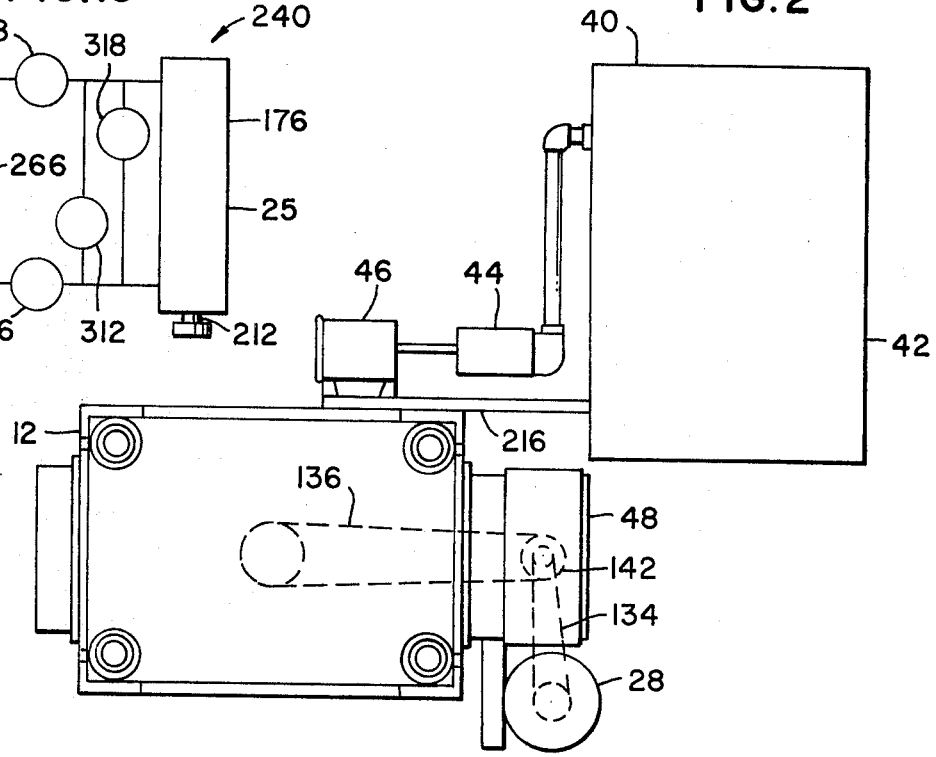
FIG. 2 is a reduced diagrammatic top view of the total form abrasion machine illustrated in FIG. 1.

The flushing system 40, as shown diagrammatically in FIG. 2, is similar to flushing systems for an electrical discharge machining. Thus, a flushing fluid which may, for example, be kerosene is placed in the tank 42. During machining with the total form abrasion machine 10, the flushing fluid is pumped from the tank 42 through the pump 44 and the filter 46 and then between the workpiece and cutting master either through a manifold and openings in the workpiece being machined or through a manifold and openings through the cutting master.

The flushing fluid removes the particles abraded from the workpiece, such as graphite particles, when the workpiece is a block of graphite to be abraded into an electrical discharge machining electrode. After passing between the workpiece and cutting master, the flushing fluid and the abraded particles are washed onto the table 16 and collected in the drain through 57 from which it is returned to the tank 42 by the return drain line 216.

A large part of the abraded particles will settle out of the flushing fluid in the tank 42. Those particles which do not settle out of the flushing fluid in the tank 42 are removed therefrom before reuse in the filter 46.

Figure 3:
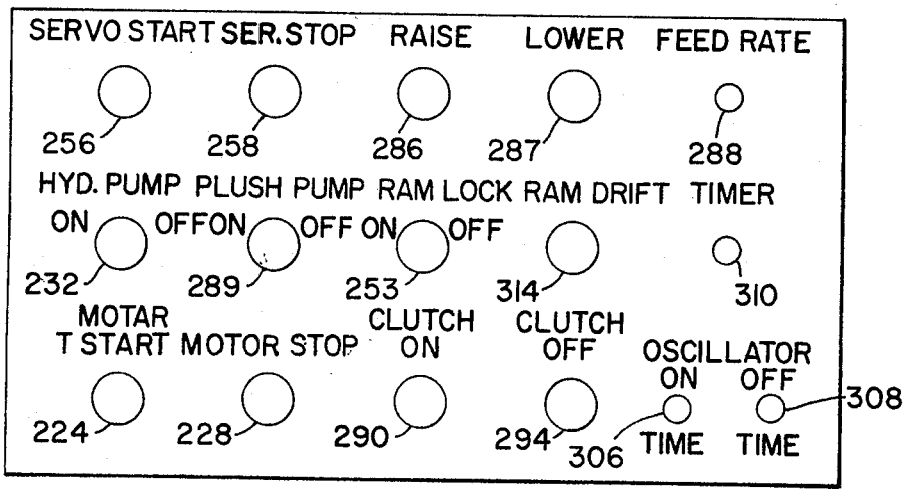
FIG. 3 is an enlarged diagrammatic representation of the control panel of the total form abrasion machine illustrated in FIG. 1.

The overall operation of the total form abrading machine 10 will be considered in conjuction with FIGS. 3, 12 and 13.

Thus, with electrical energy from an external source which may be, for example, 110 volts alternating current applied to the control circuit 218, shown in FIG. 12, through the transformer secondary winding 220 and fuse 222, the electric motor 28 may be started on pressing the motor "start" push button 224 momentarily to energize the drive motor starting relay coil 226 through the motor "stop" push button 228 which is normally closed as shown and the motor start push button 224 which is normally open as shown. Energizing the relay coil 226 will close motor starting contacts in a starting circuit for the motor 28 which is not shown and which includes a motor overload relay for activating motor overload contacts 230, as required. Also on energizing the motor starting relay coil 226, the relay contacts 232 are closed to bypass the motor start push button 224 whereby the motor start relay coil 226 will remain energized until the motor stop push botton 228 is pressed or the motor overload contacts 230 open.

The hydraulic pump ON-OFF, two-section switch 232, which is essentially a double-pole, double-throw switch, is turned on to energize the hydraulic motor relay 234 through the upper portion 236 of the switch 232. Energizing the hydraulic pump motor relay 234 actuates the hydraulic pump 238 in the hydraulic circuit 240 of FIG. 13 to provide hydraulic pressure for the ram structure 25.

Closing of the lower portion 242 of the switch 232 will energize the valve solenoids 244 of the ram lock valves 246 and 248 to open the ram lock valves and permit hydraulic fluid to flow to and return from the hydraulic cylinder 176 of the ram structure 25, providing the lower portion 250 of the ram lock limit switch 252 is closed or the ram lock ON-OFF switch 253 is in the ON position.

The servo start push button switch 254 is pressed to energize the relay coil 256 through the servo stop push button 258 and the upper portion 260 of the ram lock limit switch 252. On energizing the relay coil 256, the contacts 262 are closed to bypass the servo start push button 254 so that the relay coil 256 will remain energized until the servo stop push button is pressed, or the limit switch 252 is open.

On energizing the relay coil 256, the contacts 264 are also closed so that the ram 176 which has been biased in a "down" direction by current through the coil 268 of the electrohydraulic servo valve 266 in the hydraulic circuit 240 will in addition be biased in an "up" direction by the current through the opposing servo valve coil 270. A residual bias in a "down" direction of a predetermined amount will result, depending on the setting of the feed rate wiper arm 288 on potentiometer 289. The platen 24 may therefore be placed in an uppermost position by pressing the "raise" push button 286 to break the circuit through the coil 268. The workpiece is secured to the table 16 and a cutting master is secured to the upper platen 24 by convenient means such as clamps positioned in the slots 68 and 182.

The "lower" push button switch 287 may be pressed to move the cutting master down until it approaches contact with the workpiece on the table 16, at which time the clutch "on" push button 290 may be pressed to energize the clutch actuating relay 292 and close the bypass contacts 294 around the clutch on push button 290. The clutch 30 is then energized by an electric circuit, not shown, to cause the table to be driven in a rotary, orbital motion until the clutch "off" push button 296 is pressed or the motor stop push button 228 is pressed.

The flush ON-OFF switch 298 is placed on the ON position to energize the relay 300 which will cause the flushing motor 44 to pump flush fluid from the tank 40 through the pump 44, and the filter 46 to between the cutting master and workpiece and back to the tank 42 as above indicated.

Due to the residual downward bias of the coil 268 with both coil 268 and coil 270 energized, the cutting master will move into engagement with the workpiece in its rotary, orbital motion with the abrasive mirror image surface thereof, which is oversize for a female cutting master and undersize if a male cutting master, by the amount of eccentricity of structures 18 and 20 in the directions perpendicular to the direction of movement of the rod 212 of ram 25 to produce abrasive machining of the workpiece, as set forth in the above referenced patent and patent applications.

During the abrasion machining, the contacts 284 are periodically opened to cause the ram 24 to move the cutting master upward a controlled amount to aid in the flushing of the abraded material from between the workpiece and cutting master. The contacts 284 are pulsed by means of the relay coil 302 which is periodically energized through the multivibrator 304.

Both the pulse width and frequency of pulsing of the multivibrator may be set by means of the potentiometers 306 and 308 in the manner that electrical discharge machining circuits are pulsed. The pulsing frequency is, however, substantially lower than normally used in electrical discharge machining circuits. Thus, for example, the ram 24 may be pulsed at four times a second or once every 4 seconds.

With such pulsating operating of the ram 25 during a first time; that is, while the switch 284 is closed, the ram 24 will be lowered to place the cutting master into contact with a workpiece to be abraded and a cycle of abrasion will take place until the contacts 284 opened, at which time the rod of the ram and the cutting master is raised for a predetermined time; that is, the time the contacts 284 are opened. The raising of the rod 212 as well as the lowering thereof is at a predetermined speed as set by the wiper arm 288. Thus, the cutting master moves up a predetermined distance from the workpiece being machined, after which the contacts 284 are again closed and the ram 24 is moved forward under the bias of the coil 268 for a predetermined time to provide another abrasive cycle of machining the workpiece.

Such pulsating cycles are carried out during the entire total form abrasion machining process. It will be understood that the timing of the multivibrator may be set to provide shorter abrasion cycles and thus produce a finer finish on the workpiece at slightly longer total machining times. The finish on the workpiece is dependent on the duration of the abrasive cycles, the pressure applied and the abrasive surface of the cutting master among other factors.

In addition, as shown in FIG. 12, a timer 310 is provided in conjunction with the multivibrator 304 to, for example, provide a stutter effect in accordance with a preset program. Thus, in total form abrasion machining, it will be understood that due to the pressure applied by the ram 25 and the cutting master secured thereto to the workpiece, that the workpiece may in some circumstances deflect. The steady rhythm of the pulse is interrupted in such cases to provide a slightly longer up time or shorter down time on selected abrading cycles so that more than one abrading cycle will be accomplished on the workpiece at the same depth. Thus, in the first cycle the workpiece may be roughly abraded while deflected and during the second cycle a much finer abrasion is accomplished under considerably less deflection of the workpiece allowing tolerances to be better maintained.

When the workpiece has been completely machined, the limit switch 252 which may be on a depth gauge positioned between the lower platen and the frame of the machine is actuated, whereby the relay coil 256 and the solenoid 244 are deenergized. Deenergizing the solenoid 244 closes the valves 246 and 248 whereby the ram is fixed in vertical position so that no further machining will be accomplished on the workpiece. Deenergizing of the relay coil 256 also drops out the contacts 262 so that on pressing the ram raise push button 286 to return the ram to an uppermost position so that the workpiece may be inspected and/or removed, thus again closing the limit switch 252, the relay 256 will not again be reenergized without first pressing the push button 254.

As shown in FIG. 13, when the solenoid 244 is energized and the valves 246 and 248 are closed, the ram may be permitted to drift down at this time by a ram drift valve 312 connected across the input and return lines of the cylinder 176. Valve 312 may be either hand operated or solenoid operated in response to pressing the ram drift push button 314. Similarly, the ram lock switch 253 is provided as shown on the control panel of FIG. 3 to directly actuate the solenoid 244 and to lock the valves 246 and 248 closed when the lower portion 242 of switch 232 is closed.

The hydraulic circuit 13 further includes the pressure regulating valve 318 which provides a hydraulic bypass around the cylinder 176 which may be variably set to actuate at any predetermined pressure to thus regulate the pressure applied to the lower platen 24 and thus between the cutting master and workpiece to any desired pressure up to the maximum pressure provided by the hydraulic pump 238 to provide, for example, a total ram pressure of 35,000 pounds.

While one embodiment of the invention and modifications thereof have been considered in detail, it will be understood that other embodiments and modifications thereof are contemplated. It is the intention to include all such embodiments and modifications as are defined by the appended claims within the scope of the invention.

I claim:

1. Structure for total form abrasion machining comprising a cutting master having an abrasive mirror image surface of an exact size form to be machined in a friable workpiece which is different in size than the form to be machined by an exact predetermined amount, means for supporting the cutting master over the friable workpiece, means operable between the cutting master and workpiece for imparting a relative rotary, orbital motion between the cutting master and workpiece, comprising at least one eccentric structure operably located between a table carrying one of the workpiece and cutting master and a fixed support including a sleeve, a spindle rotatably mounted in the sleeve having a recess in one end thereof concentric with the axis of rotation of the spindle, an eccentric member comprising a disc having a first cylindrical portion on one side thereof received within the recess of the spindle which has an axis of generation concentric with the axis of rotation of the spindle and an eccentric cylinder on the other side of the disc which has an axis of generation which is offset with respect to the axis of generation of the first cylindrical portion, and second bearing means secured to the table and engaged with the eccentric cylindrical portion of the eccentric member, bearing means supporting the table and drive train means for rotation of the eccentric structure, means also operable between the cutting master and workpiece for moving the cutting master and workpiece toward each other to engage the abrasive mirror image surface of the cutting master with the friable workpiece, and means for flushing between the abrasive surface of the cutting master and workpiece to remove particles of the workpiece abraded from the workpiece by the cutting master in the absence of a difference in electrical potential between the cutting master and workpiece.

2. Structure as set forth in claim 1, wherein the eccentric member is rotatable angularly about the axis of rotation of the spindle to adjust the rotary, orbital movement of the table.

3. Structure as set forth in claim 1, and further including means operable between the cutting master and workpiece for providing a variable predetermined pressure between the cutting master and workpiece during machining.

4. Structure as set forth in claim 1, wherein the means for moving the cutting master toward the workpiece comprises an upper platen, a lower platen and a hydraulic ram positioned between the two platens for moving one of the platens toward and away from one of the workpiece and cutting master.

5. Structure as set forth in claim 4, wherein guide posts are secured to the movable platen for movement therewith which are guided at their opposite ends to prevent misalignment thereof.

6. Structure as set forth in claim 4, wherein hangers are secured to one of the platens for limiting the relative movement of the other of the platens in one direction.

* * * * *